US006616518B2

(12) United States Patent
Sun et al.

(10) Patent No.: US 6,616,518 B2
(45) Date of Patent: Sep. 9, 2003

(54) DUST COLLECTOR OF A GRINDING DEVICE

(76) Inventors: Yung Yung Sun, P.O. Box 2103, Taichung (TW); Chuan Ching Cheng, P.O. Box 2103, Taichung (TW)

( * ) Notice: Subject to any disclaimer, the term of this patent is extended or adjusted under 35 U.S.C. 154(b) by 0 days.

(21) Appl. No.: 09/905,465

(22) Filed: Jul. 16, 2001

(65) Prior Publication Data

US 2003/0013396 A1 Jan. 16, 2003

(51) Int. Cl.[7] ..... B24B 55/06
(52) U.S. Cl. ..... 451/456; 451/357; 451/359
(58) Field of Search ..... 451/456, 357, 451/359, 451

(56) References Cited

U.S. PATENT DOCUMENTS 4,192,104 A * 3/1980 Patenaude ..... 451/456
5,609,516 A * 3/1997 Courson et al. ..... 451/456
5,713,785 A * 2/1998 Nishio ..... 451/451
5,774,992 A * 7/1998 Lindenmuth ..... 451/456
5,791,979 A * 8/1998 Duncan et al. ..... 451/456
5,993,305 A * 11/1999 Chu ..... 451/357
6,027,399 A * 2/2000 Stewart ..... 451/353
6,224,471 B1 * 5/2001 Clowers et al. ..... 451/359

* cited by examiner

*Primary Examiner*—Eileen P. Morgan

(57) ABSTRACT

A dust collector of a grinding device includes an inner cover and an outer cover. The outer cover encloses the inner cover and is not extending to a whole periphery of the inner cover, but a notch is formed. The outer cover has a lower edge, and when the dust collector is installed to a grinding device, the inner cover is installed between a grinding disk of a grinding device and a body of the grinding device. The inner cover and the grinding disk define a first chamber. The outer cover enclosing the inner cover and the grinding disk; defining a second chamber with the inner cover and the grinding disk.

5 Claims, 8 Drawing Sheets

DUST COLLECTOR OF A GRINDING DEVICE

FIELD OF THE INVENTION

The present invention relates to a dust collector of a grinding device, wherein powders at the periphery of the bottom grinding surface of a grinding device can be well collected

BACKGROUND OF THE INVENTION

Referring to FIGS. 9 and 10, a prior art pneumatic grinding device 9 is illustrated. The grinding device has a grinding disk 91. The periphery of the grinding device 9 has a mask 92. The mask 92 is connected to the dust exhausting tube 93. The dust exhausting tube 93 is connected to a dust-absorbing device (not shown). The grinding disk 91 has a plurality of regular arranged holes penetrating through the grinding disk 91. The powders from the grinding tools of the grinding disk 91 will pass through the holes by the absorbing force of the dust-absorbing device. Then the powders are exhausted from the dust exhausting tube 93. Since the holes 94 of the grinding disk 91 is arranged regularly. The powders generated at the periphery of the grinding device (as indicated in arrow A) is difficult to enter into the holes 94 to cause that the powders can not enter into the dust-absorbing device but to accumulate on the surface of a work piece. No preferred grinding effect is formed. The accumulated powders causes that the grinding on the surface can not be viewed.

Furthermore, since the surface is accumulated with powders, the grinding devices move greatly. Not only the environment is polluted, but also the powders will be breathed by users. Therefore, a great damage occurs to the user.

SUMMARY OF THE INVENTION

Accordingly, the primary object of the present invention is to provide a dust collector of a grinding device, wherein the dust collector of a grinding device includes an inner cover and an outer cover. The outer cover has a lower edge, and when the dust collector is installed to a grinding device, the inner cover is installed between a grinding disk of a grinding device and a body of the grinding device. The inner cover and the grinding disk define a first chamber. The outer cover defines a second chamber with the inner cover and the grinding disk. The powders at the periphery of the bottom of the grinding disk may pass through these chambers to enter into the dust exhausting tube.

Another object of the present invention is to provide a dust collector of a grinding device, wherein the outer cover has a notch so that the operation of grinding may be viewed from the notch and then the position and other conditions of the grinding disk can be adjusted.

A further object of the present invention is to provide a dust collector of a grinding device, wherein the outer cover serves to prevent the powders from diffusing in the air so that secondary pollution is prevented, and moreover, the efficiency is improved. Besides, it is prevented that a user breathes the powders so as to hurt the body.

The various objects and advantages of the present invention will be more readily understood from the following detailed description when read in conjunction with the appended drawing.

DETAILED DESCRIPTION OF THE INVENTION EMBODIMENTS

Figure 1:
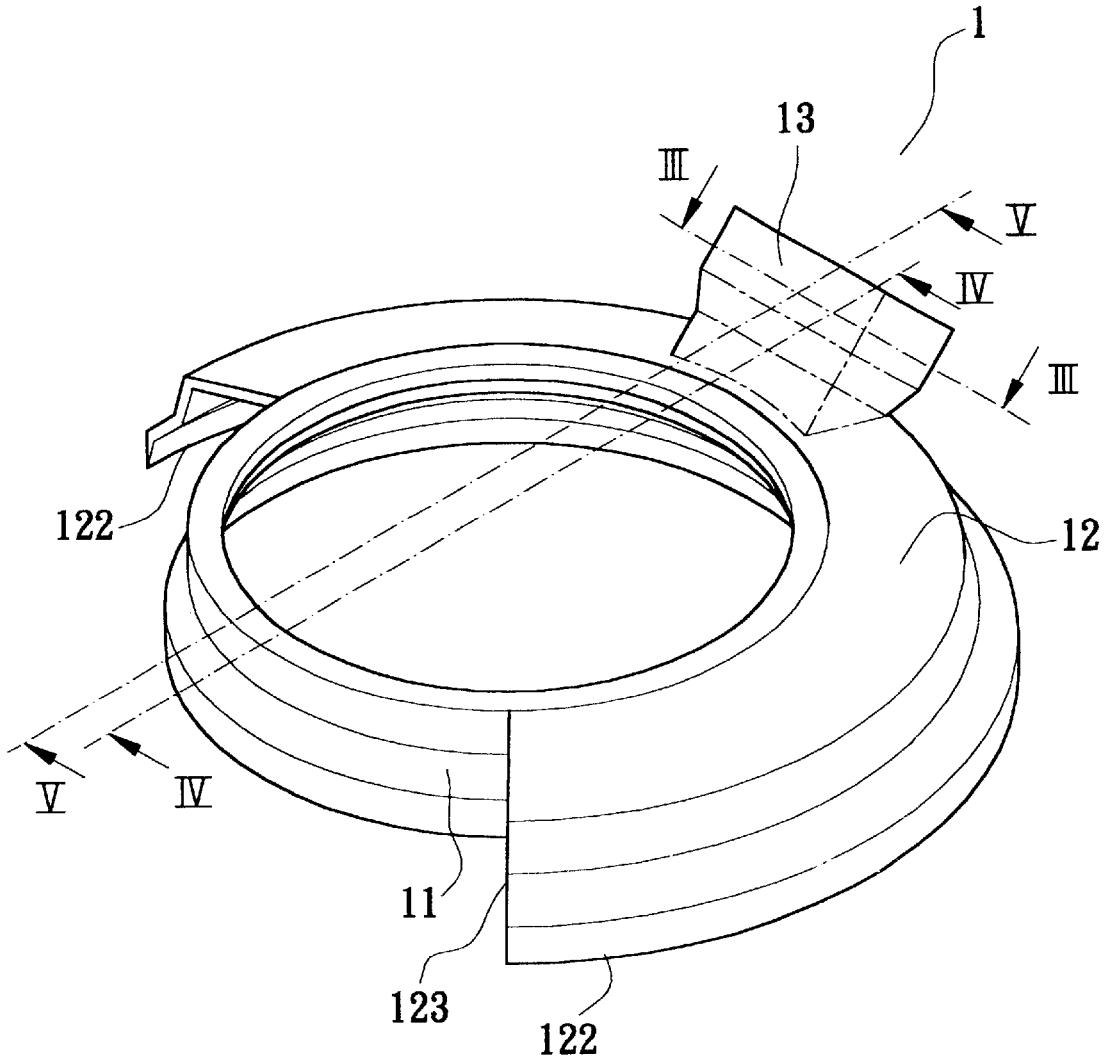
FIG. 1 is a perspective view of the present invention.
Figure 2:
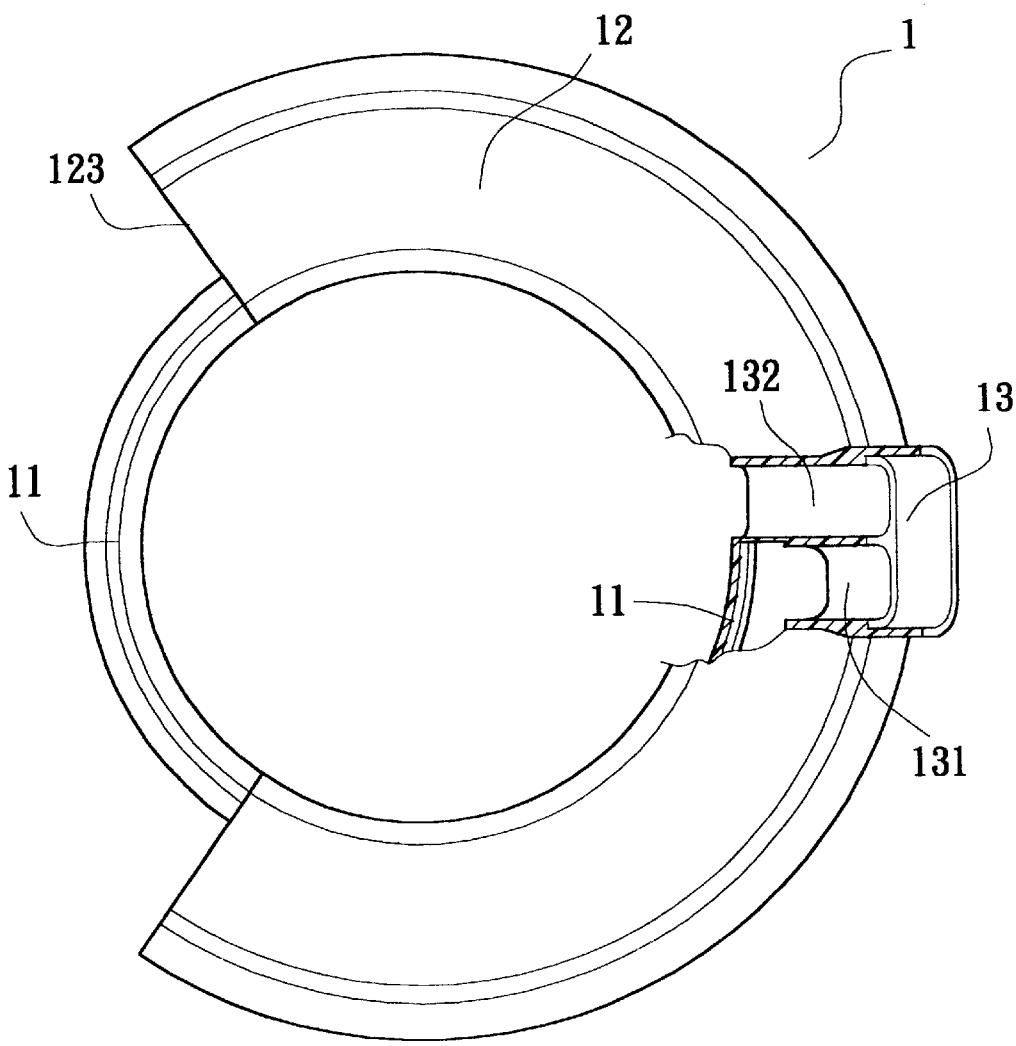
FIG. 2 is a partial cross sectional view of the present invention.
Figure 3:
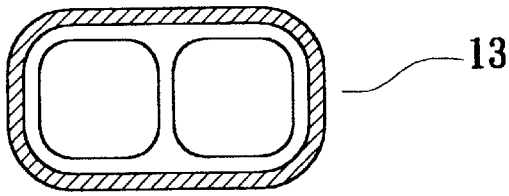
FIG. 3 is a cross sectional view along III—III of FIG. 1.
Figure 4:
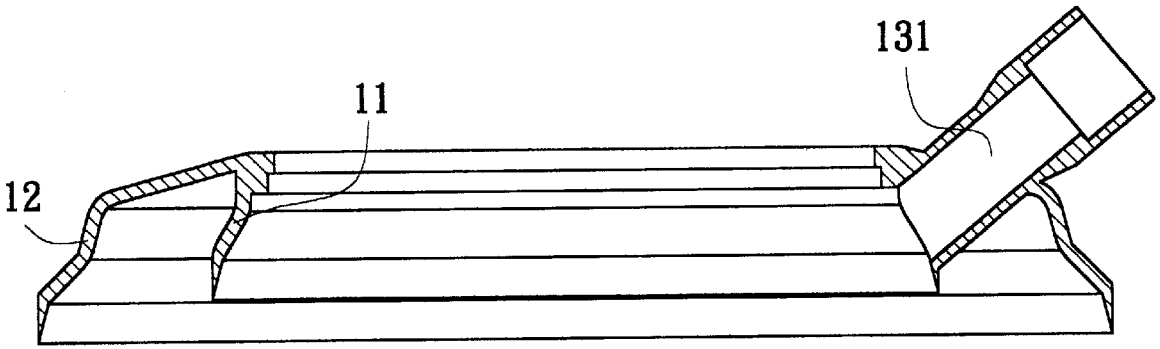
FIG. 4 is a cross sectional view long IV—IV of FIG. 1.
Figure 5:
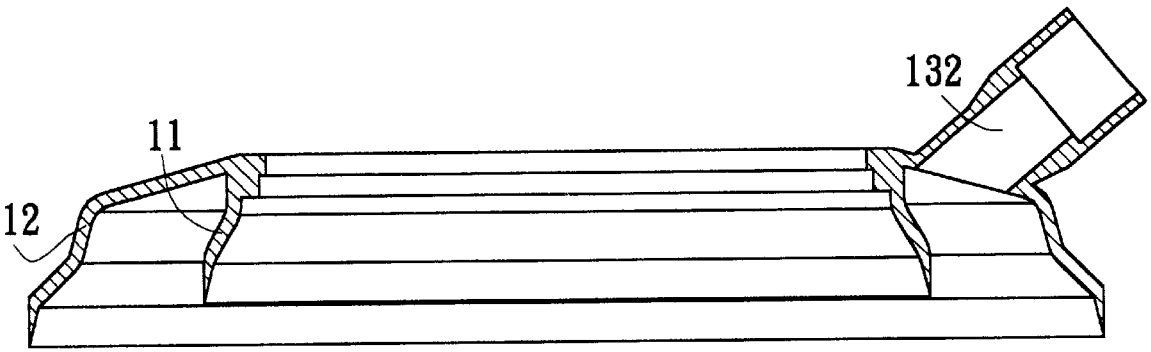
FIG. 5 is a cross sectional view along V—V of FIG. 1, wherein a second dust exhausting tube is illustrated.

Referring to FIGS. 1 to 8, the preferred embodiment of the present invention is illustrated. However, all disclosed in the description is only used to make those skilled in the art to fully understand the present invention, not to confine the scope of the present invention.

Referring to FIGS. 1 to 5, a dust collector of a grinding device in accordance with the present invention comprises an inner cover 11 and an outer cover 12 having an approximate round shape. In this embodiment, the outer cover 12 is integrally connected to a top periphery of the inner cover 11 and is enclosed around the inner cover 11. A notch 123 is formed on the outer cover 12. A main dust exhausting tube 13 is connected to the outer cover 12 and corresponds to the notch 123. The main dust exhausting tube 13 includes a first dust exhausting tube 131 defined in the main dust exhausting tube 13 and extending to an inner periphery of the inner cover 11, and a second dust exhausting tube 132 defined in the main dust exhausting tube 13 and extending to an inner periphery of the outer cover 12.

The first dust exhausting tube 131 and second dust exhausting tube 132 may have other various arrangement ways. For example, after the first dust exhausting tube 131 extending through the outer cover 12, it is enclosed by the second dust exhausting tube 132.

Figure 6:
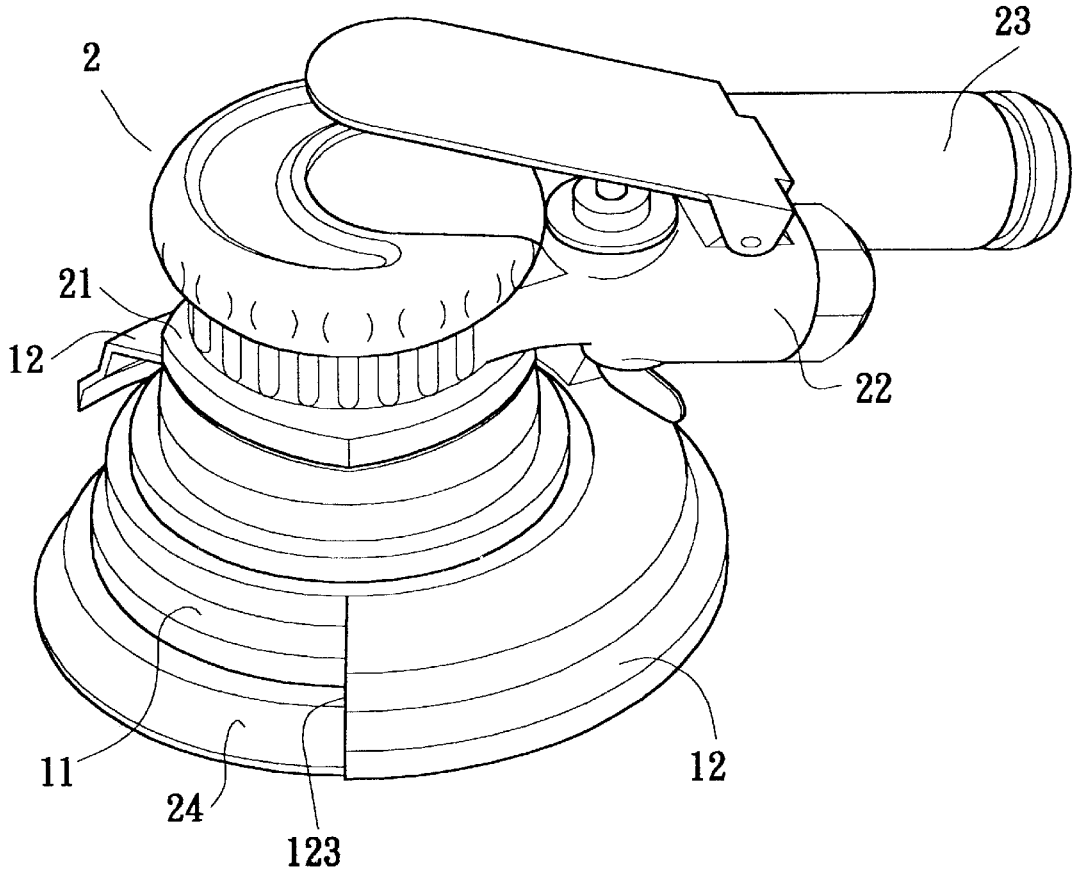
FIG. 6 shows that the present invention is installed to a grinding device.
Figure 7:
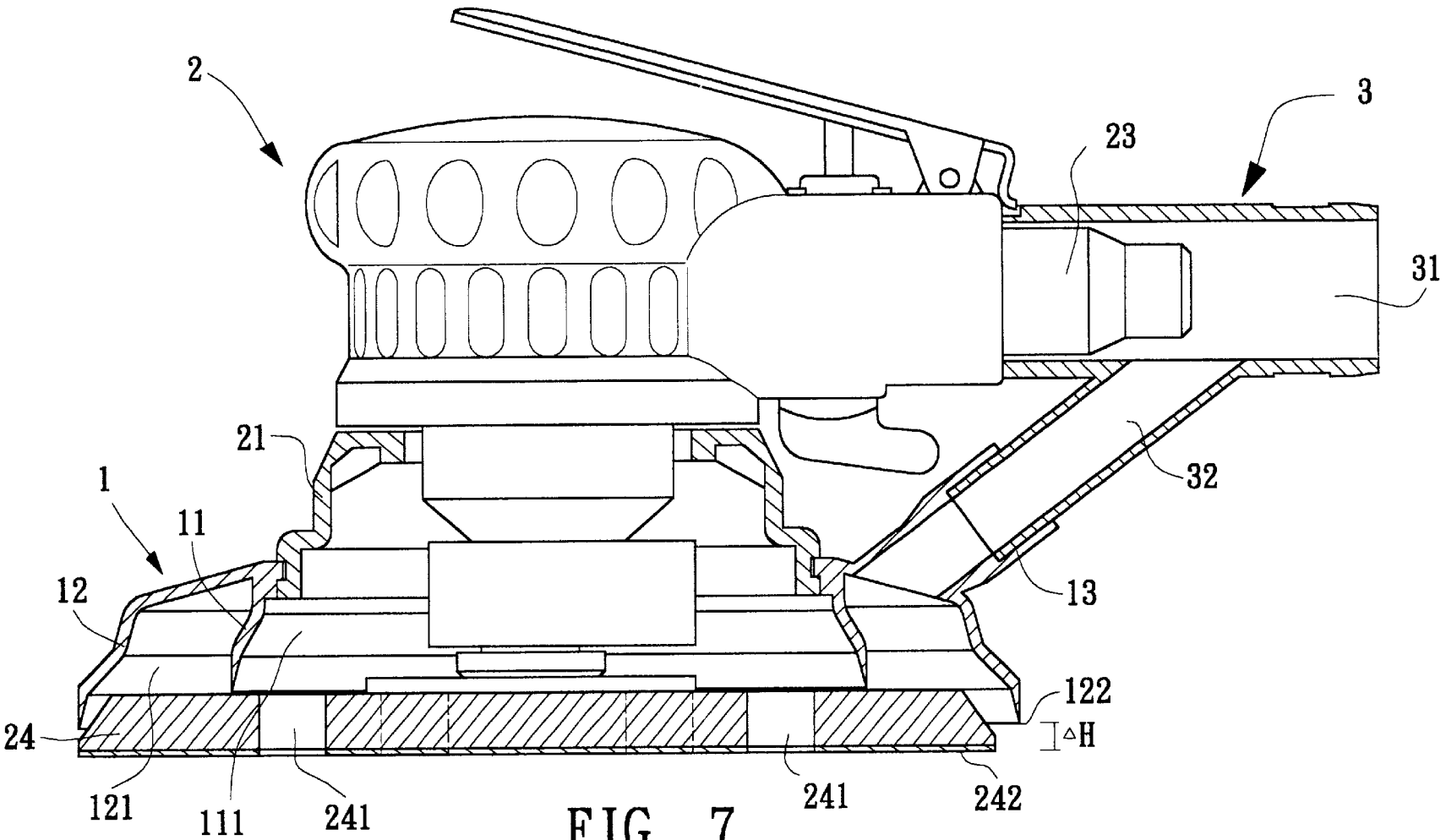
FIG. 7 shows that a connector is installed to grinding device with a dust collector of the present invention.

Referring to FIGS. 6 and 7, the present invention is adapted to be mounted on a pneumatic grinding device 2. The grinding device 2 has a body 21. The body 21 has a gas inlet tube 22 extending from the body 21, a gas exhausting tube 23 extending from the body 21, and a grinding disk 24 for grinding. The grinding disk 24 has a plurality of openings 241 longitudinally defined therein. The inner cover 11 of the dust collector 1 is mounted between the grinding disk 24 and the body 21 to define a first chamber 111 between the grinding disk 24 and inner cover 11. The outer cover 12 encloses the grinding disk 24 and defines a second chamber 121 with the grinding disk 24. The second chamber 121 is defined between the grinding disk 24, the inner cover 11 and the outer cover 12. The first dust exhausting tube 131 communicates with the first chamber 111 and the second dust exhausting tube 132 communicates with the second chamber 121. In the preferred embodiment of the present invention, the grinding disk 24 partially extends through the outer cover 12 for grinding a work piece (not shown).

Referring to FIG. 7, the dust collector in accordance with the present invention further comprises a connector 3 attached to the main dust exhausting tube 13. The connector 3 is Y-shaped and includes a gas outlet tube 31 having a first end adapted to communicate with the gas exhausting tube 23 of the grinding device 2 and a second end connected to a dust collecting bag (not shown) of a dust-absorbing device (not shown), and a dust-absorbing tube 32 having a first end communicating with the main dust exhausting tube 13 and a second end communicating with the gas outlet tube 31.

Therefore, the dusts at the peripheral of the grinding disk 24 is absorbed to the second chamber 121 due to a siphon effect of the airflow of the gas outlet tube 31 when the waste bas from the grinding device 2 is exhausted from the gas exhausting tube 23. Then the dusts pass through the second dust exhausting tube 132 and dust-absorbing tube 32 and then enter into the dust collecting bag via the gas outlet tube 31.

The grinding powders near the opening 241 of the grinding disk will enter into the first chamber 111 via the opening 241 due to the absorbing force of the dust collector when the grinding device 2 is actuated and grinding the work piece. Then the dust powders pass through the first dust exhausting tube 131, the dust-absorbing tube 32 of the connector 3 and the gas outlet tube 31 so as to be exhausted. The powders on the periphery of the grinding disk 24 will enter into the second chamber 131, and pass through the second dust exhausting tube 132, the dust-absorbing tube 32 and the gas outlet tube 31 so as to be exhausted to the dust collecting bag.

As described above, by the dust connecting structure of the present invention, other than collecting through the opening 241, the powders from grinding at the periphery of the grinding disk 24 will be absorbed through the second chamber 121 due to the second chamber 121 defined by the outer cover 12 and the shielding effect of the outer cover 12, and thereof, the powders can be removed completely.

Besides, since the outer cover 12 does not extend to form a whole circle and has a notch 123. Therefore, when the grinding device 2 is operated, the operation of grinding may be viewed from the notch 123 and then the position and other conditions of the grinding disk 24 can be adjusted.

Moreover, when the dust collector 1 of the present invention is installed in the grinding device 2, since the outer cover 12 encloses the inner 11 and the grinding disk 24, the outer cover 12 serves to prevent the powders from diffusing in the air so that secondary pollution is prevented, and moreover, the efficiency is improved. Besides, it is prevented that a user absorbs the powders so as to hurt the body.

Figure 8:
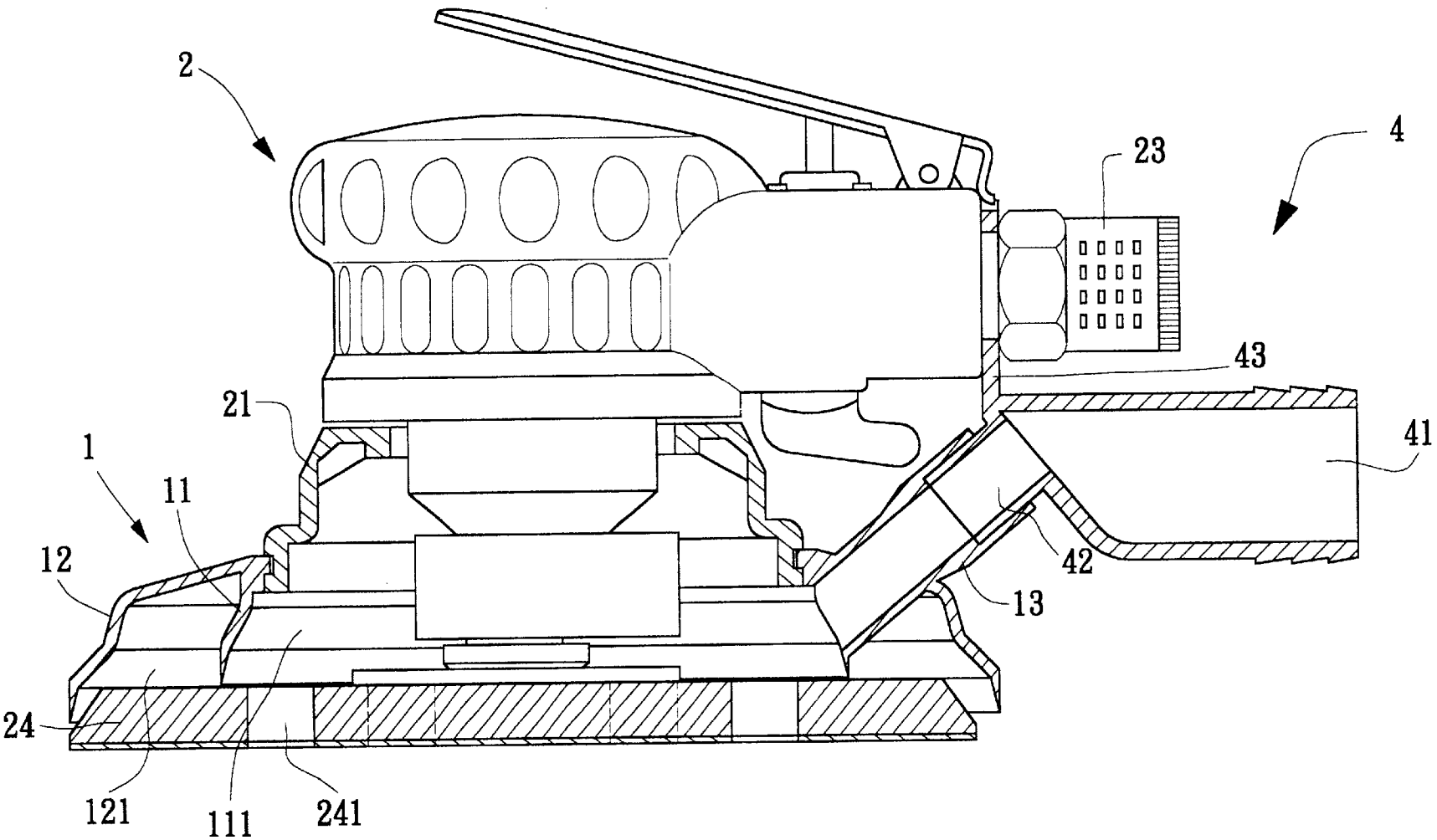
FIG. 8 shows that a connector is installed to grinding device with a dust collector of the present invention.
Figure 9:
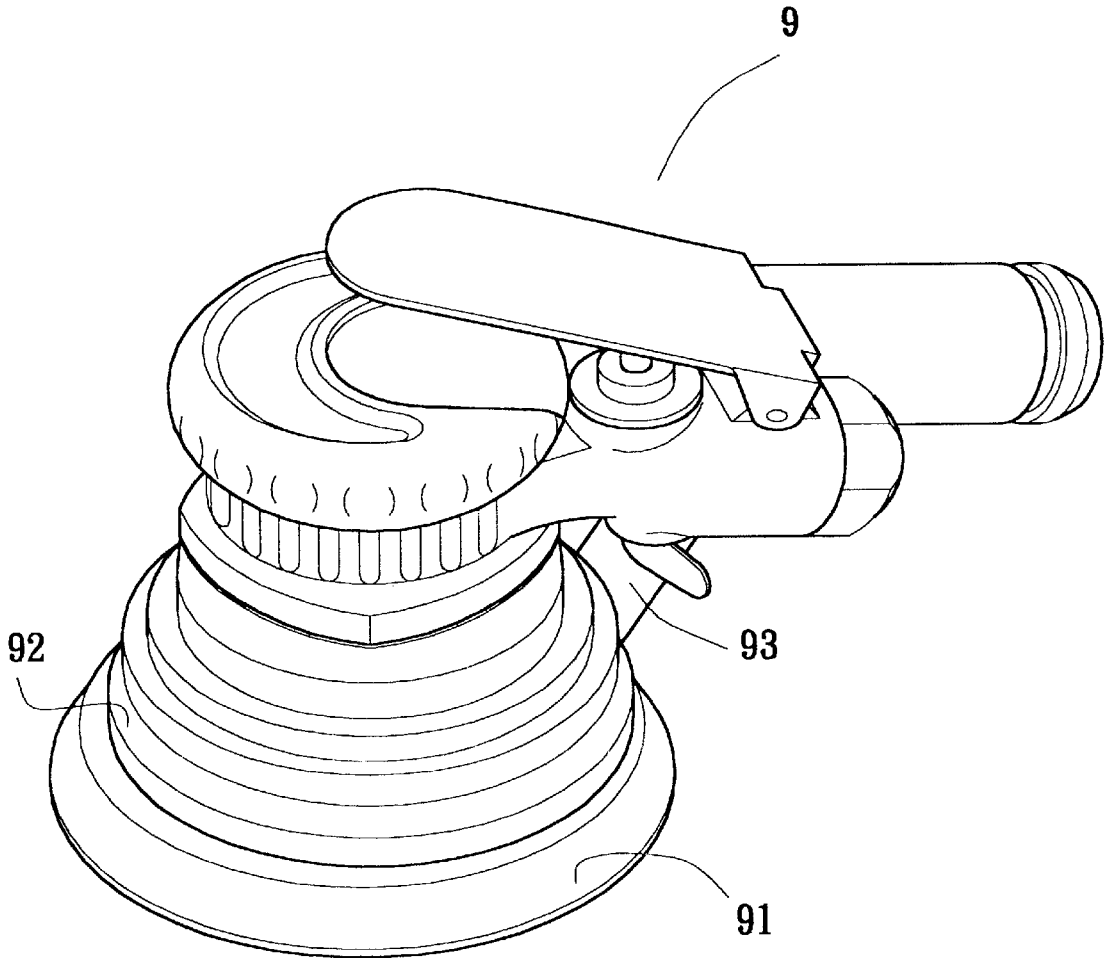
PRIOR ART FIG. 9
FIG. 9 is a perspective view of a prior grinding device.
Figure 10:
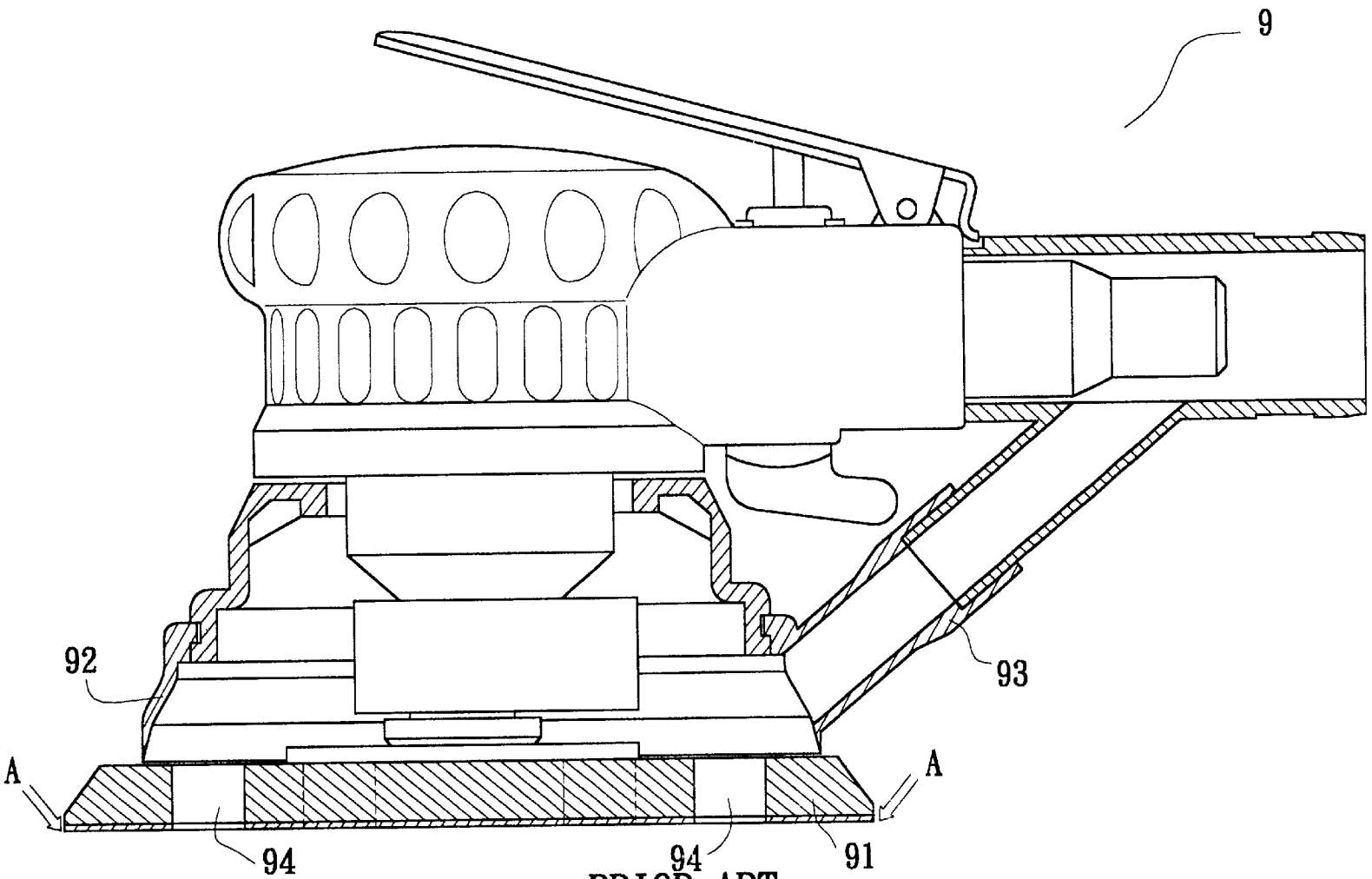
PRIOR ART FIG. 10
FIG. 10 is a cross sectional view of a prior grinding device.

Referring to FIG. 8, it shows another embodiment of the present invention. A connector 4 is adapted to be attached to the grinding device 2. The connector 4 has a dust-absorbing tube 42 communicating with the main dust exhausting tube 13 and a gas outlet tube 41 having a first end communicating with the dust-absorbing tube 42. The gas outlet tube 41 has a second end adapted to be connected to the dust collecting bag of the dust-absorbing device (not shown). The connector 4 has a fixing portion 43 extending from an outer periphery of the connector 4. The dust exhausting tube 23 extends through the fixing portion 43 and is securely inserted into the grinding device 2 to hold the connector 4 in place.

The working air entering into the body 21 of the grinding device 2 will vent out from the gas exhausting tube 23 when the grinding device 2 is operated. The powders on the bottom and periphery of the grinding disk 24 will be absorbed to the first chamber 111 and the second chamber 121 by the absorbing force of the dust-absorbing device. Then, the powders pass through the main dust exhausting tube 13, dust-absorbing tube 42 and the gas outlet tube 41 to be absorbed into the dust collecting bag of the dust-absorbing device.

The present invention are thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A dust collector of a grinding device that includes a body and a grinding disk rotatably mounted on the body of the grinding device, comprising an inner cover and an outer cover enclosing around and connected to a top of the inner cover, the outer cover having a notch defined therein for viewing the grinding condition, the inner cover adapted to be installed between the grinding disk of the grinding device and the body of the grinding device, a first chamber defined between the inner cover and the grinding disk and a second chamber defined between the inner cover, the outer cover and the grinding disk, a main exhausting tube connected to the outer cover and communicating with the first chamber and the second chamber, a connector having a first end connected to the main exhausting tube and a second end adapted to be connected to a dust-absorbing device, thereby the dust powders pass through the main exhausting tube and the connector so as to be exhausted.

2. The dust collector of a grinding device as claimed in claim 1, wherein the outer cover is integrally connected to a top of the inner cover.

3. The dust collector of a grinding device as claimed in claim 1, wherein the main dust exhausting tube comprises a first dust exhausting tube defined in the main dust exhausting tube and extending to an inner periphery of the inner cover, and a second dust exhausting tube defined in the main dust exhausting tube and extending to an inner periphery of the outer cover, the first dust exhausting tube protrudes out of the outer cover.

4. The dust collector of a grinding device as claimed in claim 3, wherein the connector is Y-shaped and comprises a gas outlet tube having a first end adapted to communicate with a gas exhausting tube of the grinding device and a second end adapted to connect to a dust collecting bag of the dust-absorbing device, and a dust-absorbing tube having a first end communicating with the main dust exhausting tube and a second communicating with the gas outlet tube.

5. The dust collector of a grinding device as claimed in claim 3, wherein the connector comprises a dust-absorbing tube communicating with the main dust exhausting tube and a gas outlet tube having a first end communicating with the dust-absorbing tube and a second end adapted to be connected to a dust collecting bag of the dust-absorbing device, the connector having a fixing portion extending from an outer periphery of the connector and securely attached to the grinding device to hold the connector in place.

* * * * *